US008448649B2

(12) United States Patent
Kloeppel-Riech et al.

(10) Patent No.: US 8,448,649 B2
(45) Date of Patent: May 28, 2013

(54) HAIR CARE DEVICE WITH OPTIMIZED ION RELEASE

(75) Inventors: Michael Kloeppel-Riech, Friedberg (DE); Katja Honnefeller, Friedrichsdorf (DE); Norbert Smetana, Frankfurt am Main (DE); Olaf Soerensen, Mainz (DE); Juergen Seng, Kelkheim (DE); Timo Hasenpflug, Frankfurt am Main (DE)

(73) Assignee: Braun GmbH, Kronberg (DE)

( * ) Notice: Subject to any disclaimer, the term of this patent is extended or adjusted under 35 U.S.C. 154(b) by 96 days.

(21) Appl. No.: 12/673,981

(22) PCT Filed: Jul. 25, 2008

(86) PCT No.: PCT/EP2008/006132

§ 371 (c)(1), (2), (4) Date: Jun. 2, 2010

(87) PCT Pub. No.: WO2009/015833

PCT Pub. Date: Feb. 5, 2009

(65) Prior Publication Data

US 2011/0315158 A1 Dec. 29, 2011

(30) Foreign Application Priority Data

Jul. 27, 2007 (DE) ..... 10 2007 035 247

(51) Int. Cl.
*A46B 15/00* (2006.01)

(52) U.S. Cl.
USPC ..... 132/148; 132/271

(58) Field of Classification Search
USPC ..... 132/118, 120, 126, 148, 219, 221, 132/272
See application file for complete search history.

(56) References Cited

U.S. PATENT DOCUMENTS 4,797,966 A * 1/1989 Fong ..... 15/186
5,150,491 A * 9/1992 Ikemoto ..... 15/1.52

(Continued)

FOREIGN PATENT DOCUMENTS

JP 2004/344354 A 12/2004

OTHER PUBLICATIONS

U.S. Appl. No. 12/674,051, filed Jun. 2, 2010, Honnefeller et al.

(Continued)

*Primary Examiner* — Robyn Doan
*Assistant Examiner* — Tatiana Nobrega
(74) *Attorney, Agent, or Firm* — Jeffrey V. Bamber; Kim W Zerby

(57) ABSTRACT

The present invention relates to a hair care device (1) with a handle (3), an operational head connected to the handle (3) having a hair treatment apparatus (5), in particular a bristle field and/or a comb tooth field, and an ion-producing apparatus (9) for producing ions on the hair, having at least one ion outlet (11). According to the invention, the hair care device (1) is characterized in that said hair care device has the feature of a back side (8) facing away from the hair treatment apparatus (5) and an ion-producing apparatus (9) for producing ions on the hair which has at least one switching unit, an ion source, an ion outlet (1) and a sheath surrounding the ion outlet (11). Said hair care device (1) has in addition a grounding surface for the removal/limiting of electronic loads, which is arranged on a part of the housing in the area of the ion outlet, wherein the ion source has a potential level of −10 to −3 KV relative to the potential level of the grounding surface, the sheath has a potential level of −2.5 to −1 KV or of 20% to 50% of the potential level of the ion source relative to the potential level of the grounding surface, and the back side (8) of the device has a potential level of −500 to −100V or from 2% to 10% of the potential level of the ion source relative to the potential level of the grounding surface.

14 Claims, 9 Drawing Sheets

U.S. PATENT DOCUMENTS

Figure 1:
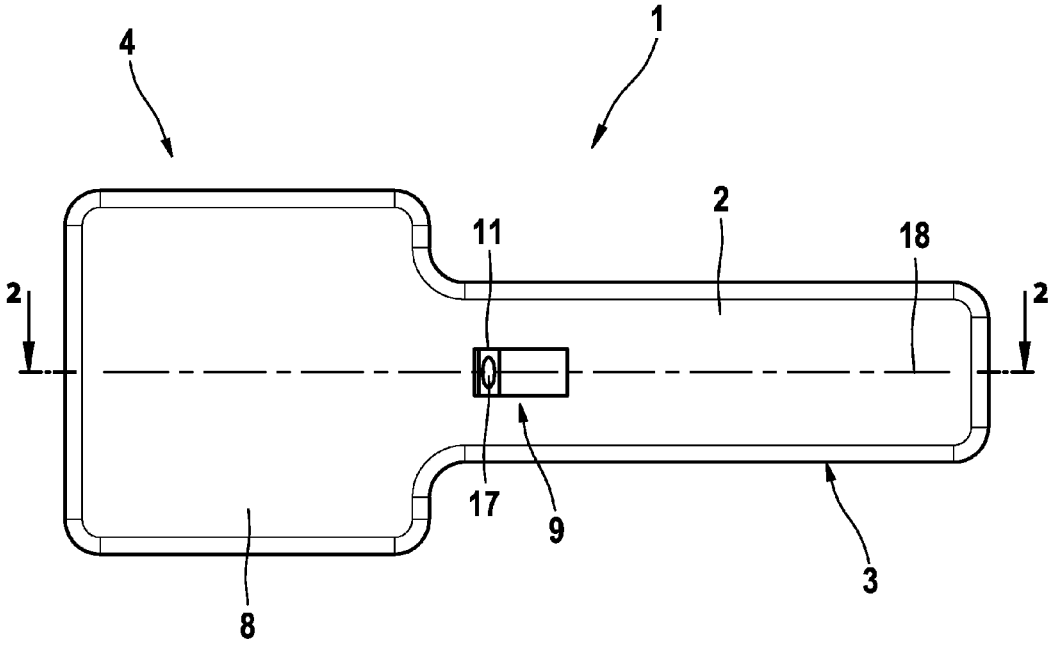

| | | | | |
|---|---|---|---|---|
| 6,191,930 | B1 * | 2/2001 | Ramchandani | 361/213 |
| 6,672,315 | B2 * | 1/2004 | Taylor et al. | 132/116 |
| 6,907,888 | B2 | 6/2005 | Saida et al. | |
| 6,910,281 | B2 * | 6/2005 | Ito | 34/96 |
| 6,986,212 | B2 * | 1/2006 | Saida et al. | 34/98 |
| 7,287,532 | B2 * | 10/2007 | Hafemann | 132/232 |
| 7,584,759 | B2 | 9/2009 | Yasuda et al. | |
| 7,644,511 | B2 * | 1/2010 | Ishikawa et al. | 34/78 |
| 2002/0062836 | A1 * | 5/2002 | Saida et al. | 132/271 |
| 2002/0100488 | A1 * | 8/2002 | Taylor et al. | 132/271 |
| 2004/0129288 | A1 * | 7/2004 | Saida et al. | 132/228 |
| 2005/0016559 | A1 * | 1/2005 | Saida et al. | 132/271 |
| 2005/0284495 | A1 * | 12/2005 | Yasuda et al. | 132/272 |
| 2008/0040878 | A1 * | 2/2008 | Choi et al. | 15/184 |
| 2011/0005539 | A1 | 1/2011 | Honnefeller et al. | |
| 2011/0088275 | A1 | 4/2011 | Kloeppel-Riech et al. | |
| 2011/0088714 | A1 | 4/2011 | Kloeppel-Riech et al. | |
| 2011/0094535 | A1 | 4/2011 | Honnefeller et al. | |

OTHER PUBLICATIONS

U.S. Appl. No. 12/674,053, filed Mar. 2, 2010, Kloeppel-Riech et al.
U.S. Appl. No. 12/674,732, filed May 27, 2010, Kloeppel-Riech et al.
U.S. Appl. No. 12/669,915, filed Aug. 10, 2012, Honnefeller et al.
All Office Actions, U.S. Appl. No. 12/674,051.
All Office Actions, U.S. Appl. No. 12/674,053.
All Office Actions, U.S. Appl. No. 12/669,915.
All Office Actions, U.S. Appl. No. 12/674,732.

* cited by examiner

HAIR CARE DEVICE WITH OPTIMIZED ION RELEASE

The present invention relates to a hair care device with a handle, an operational head connected to the handle having a hair treatment apparatus, in particular a bristle field and/or a comb tooth field, and an ion-producing apparatus for producing ions on the hair having at least one ion outlet.

Recently, hair care devices, particularly hair brushes, have been known that, in addition to their primary function, that is, in the case of a hairbrush, to comb, brush and style the hair, produce ions as a supplemental application. Ions of this kind are usually molecules charged with negative electrons. With the help of such an ion application, the hair and the care of the hair can be improved; in particular, a static charge on the hair causing it to stand up can be avoided.

From US 2005/284495 a hair brush or a hair dryer with an integrated brush attachment is known having an ion outlet which releases ions in the direction of the operational head, both on the back side of the device facing away from the bristle field, and on the front side of the device which bears the bristle field.

With these kinds of hair care devices having ion application, on the one hand, the ions should of course be targeted onto the hair, and on the other hand, they should not be applied selectively in certain spots, but should rather be applied as evenly as possible to the hair. The ion discharge is impeded in this not only by direct mechanical obstacles such as the user's hand or hair coming in front of the ion outlet, but also by electrostatic counter fields produced by strongly negatively charged components which repel negatively charged ions, so to speak, or components with strong positive charges which have an attractive field-effect on the ions. This kind of charge can even arise from the bristle field itself, for example, when the hair is brushed with it. Also, in the area of ion discharge, electrostatic fields can be produced which impede the emergence of the ions.

A further aspect of the previously known hair care devices of the type mentioned above which needs improvement is safety of use, which can be compromised, due to the strong charges mentioned above.

As a result, the object of the present invention is based on creating a hair care device of the kind described which avoids the disadvantages of the prior art and develops this in an advantageous way. In particular, by simple means, ions will be delivered onto the hair in an even, efficient manner, without compromising the safety of using the device.

This object is achieved according to the invention by means of a hair care device according to Claim 1. Preferred embodiments of the invention are the subject matter of the dependent claims Therefore, it is proposed that electrostatic charge and counter fields be eliminated through appropriate counter measures, at least on the parts of the hair care device that are in the way of delivering the ions to the hair or that interfere with the discharge of the ions. Without interference from such electrostatic counter fields, a uniform but nevertheless targeted and efficient distribution of ions can be applied to the hair, with a simple design of the ion discharging device, which can be accomplished with only a single ion outlet, in the case of a simple design of the invention. According to the invention, the hair care device is characterized in that it has a back side of the device facing away from the hair treatment apparatus, as well as an ion-producing apparatus for discharging ions on the hair, having at least one switching unit, an ion source, an ion outlet and a sheath surrounding the ion outlet, wherein the hair care device, in addition, has a grounding surface for the removal/limiting of electronic charges, arranged on a part of the housing in the vicinity of the ion outlet, wherein the ion source has a potential level of −10 to −3 KV relative to the potential level of the grounding surface, the sheath has a potential level of −2.5 to −1 KV or of 20% to 50% of the potential level of the ion source relative to the potential level of the grounding surface, and the back side of the device has a potential level of −500 to −100V or of 2% to 10% of the potential level of the ion source relative to the potential level of the grounding surface.

Depending on the type of hair care device, the ion source can have a potential level relative to the potential level of the grounding source selected from the range of from minus (−) 10 kilovolt (KV) to −8 KV or from −8 KV to −6 KV or from −6 KV to −3 KV.

The sheath enclosing the ion outlet can be designed in various forms. For example, it can be cylindrical or conical. It can be a good electrical conductor, so that the sheath takes on almost the potential level of an adjacent grounding surface, or it can be a poor conductor, so that in can be partially charged in spite of the adjacent ground; however, the charge will be limited by the adjacent ground. The sheath can have a potential level relative to the potential level of the grounding surface selected from the range of from minus (−) 2.5 kilovolt (KV) to −2 KV or from −2 KV to −1.5 KV or from −1.5 to −1 KV. The potential level of the sheath should be adjusted to the potential level of the ion source. The potential level of the sheath can be selected from the range of from 50% to 40% or from 40% to 30% or from 30% to 20% of the potential level of the ion source.

"The back side of the device can likewise be designed in various forms. It can be a good electrical conductor, so that the back side of the device takes on at least close to the potential level of an adjacent grounding surface, or it can be a poor conductor, so that it can be partially charged in spite of the adjacent ground; however, the charge will be limited by the adjacent ground. The back side of the device can have a potential level relative to the potential level of the grounding surface selected from a range of from minus (−) 500 volts (V) to −300 V or from −300 V to −200 V or from −200 V to −100 V. The potential level of the back side of the device should be adjusted to the potential level of the ion source. The potential level of the back side of the device can be selected from the range of from 10% to 8% or from 8% to 5% or from 5% to 2% of the potential level of the ion source."

In the case of a non-conductive or at least a poorly conductive housing component (like the housing back side or the sheath) the potential level of the housing component can be different in various places. In these cases, the potential level is best measured on the outside of a component. In the scope of the present invention, it is sufficient if the potential level at one of the points on the outside of the component facing the ion stream is within the above ranges. This potential level can be considered to be the potential level of the component.

An optimal potential distribution can be influenced by the distribution of grounding surfaces on the hair care device and by the selection of materials, especially relating to their conductivity.

The grounding surfaces, that is, in each case the first grounding surface and the second and further grounding surfaces, alone or together, can be configured in any way. They can have a planar or a point contact area, by which electronic charges are removed/limited. Additionally, they can have a contact plate attached to another surface, for example, to the inner surface or outer surface of a plastic component, by adhesion, for example. The contact surface can be designed to be rigid or flexible. Additionally, the grounding surface can comprise an electric contact screw, which is screwed into a screw boss in the plastic component.

A grounding surface is considered to be "in the vicinity" of another if it can affect the other component, that is, if it is capable of removing/limiting the electronic charge of the other component. The component can be in direct contact with the grounding surface or in only indirect contact. Even in indirect contact, the distance from the component should not be greater than 1 or 5 or 10 millimeters. The interval can depend on the electrical conductivity of the component or of the component to which it spans.

Further, the operational head and/or a housing component in the vicinity of the ion outlet can have at least one additional grounding surface for removing/limiting electrostatic charges ("third grounding surface"). Such a grounding surface on the operational head and/or on one of the housing components encasing the ion outlet prevents or limits an excessive charge, and accordingly, prevents or limits the electrostatic fields in the area of the operational head and in the area of the ion outlet, which could impede the application of ions to the hair. In particular, such grounding surfaces could be present both on the operational head and on the housing component in the vicinity of the ion outlet.

The grounding surface can be designed fundamentally differently. In particular, the grounding surface can be designed as a metal surface which can be mounted on a non-conductive body or housing component of the operational head and/or of the ion outlet, preferably made of plastic. The body of the operational component or the ion outlet itself can further be designed as an injection molded plastic component or as a plastic component manufactured in some other way. The grounding surface in the form of a metal surface is attached advantageously to the outer surface of the said body component and can form its outer surface; this not only prevents fields created by ion discharge, but also increases the operational safety of the hair care device.

Alternatively, or in addition to a grounding surface on the outside of a body component, in a further advantageous embodiment of the invention, a grounding surface can be provided on an inside surface of a body component. In this way, the arrangement on the inner or outer surface can vary, depending on the component. While the grounding surface on the said operational head and/or on one of the outlet housings encasing the ion outlet can be advantageous on an outer surface of the corresponding body component, on the other hand, certain advantages are associated with providing a grounding surface on the inner surface of a further corresponding body component in the vicinity of the ion outlet, especially on a body component over which the ion cloud diffuses, located behind the outlet in the discharge direction.

Regarding the arrangement of the grounding surfaces, various embodiments can be advantageous. On the operational head, an advantageous arrangement can be attaching the grounding surface to the hair treatment apparatus, in particular, to the bristle field and/or to the comb tooth field. For example, the grounding surface can form the bed, so to speak, bearing the bristles or comb teeth of the bristle field or optionally also other differently designed treatment tools for the hair treatment apparatus. Alternatively, or in addition to the above mentioned bristle field and/or comb tooth field, the hair treatment apparatus can have, for example, a hair-care surface made of a suitable material, such as for example ceramic. Alternatively or additionally, a heating surface with suitable shape, in particular a flat, concave, or convexly rounded application surface, may be provided.

Also regarding the arrangement of the ion outlet ("first grounding surface"), as well as in its vicinity, various configurations can be advantageous. According to an advantageous embodiment of the invention, the ion outlet comprises a preferably separate housing module shaped as a case or a box, which encases the high voltage element producing the ions and having an orifice in which an outlet opening is provided for discharging the ions produced by the high voltage element. Advantageously, the grounding surface mentioned above is arranged on the side facing away from the orifice of the above mentioned housing module. In particular, the orifice of the housing module can be designed to be completely free of counter electrodes. In this way, the grounding surface can be arranged on a side surface of the outlet housing adjacent to the orifice, peripherally enclosing the high voltage element mentioned above, which is preferably bar-shaped, pin-shaped or pointed. Alternatively, or in addition, a grounding surface can also be provided on a back surface of the outlet housing, opposite the orifice.

Alternatively, or in addition to such a grounding surface on the outlet housing, a housing module adjacent to the ion outlet and/or a housing surface in the vicinity of the ion outlet can be provided with a grounding surface ("second grounding surface"). In particular, a housing module can be grounded downstream from the ion outlet over which the ion cloud diffuses or should diffuse, wherein this housing module advantageously is made of a non-conductive material in the manner stated above and can be provided with a grounding surface mounted on it. In this connection, in the simplest embodiment, the electrical grounding of the housing module in the vicinity of the ion outlet can be accomplished by means of an electrically contacted screw which is screwed into a screw boss in the plastic component. Alternatively or additionally, the electrical grounding can be accomplished by means of contact pressure from a metal electrode that forms a grounding surface of the kind mentioned above. In this way, the said housing component or components can be grounded by contact with the ground of the device's circuit, whereby an electrostatic charge, while not entirely impossible, is sufficiently limited to keep the electrical counter fields created by the charge so small that they do not impede the dispersion of the ions from the ion outlet.

The electrical grounding of the housing component over which the ion cloud disperses is accomplished advantageously not in the field of view of the ion cloud but rather on one of the sides of the housing component facing away from the ion outlet, in particular on one of the inner surfaces of the housing component.

According to one advantageous embodiment of the invention, and in particular of the second grounding surface, the housing of the device is provided with an ion guide mechanism or ion control device in the area over which the ion cloud being discharged from the ion outlet disperses, and/or in the vicinity of the ion outlet. Control of the ions can be achieved advantageously in this way, in that, in the vicinity of the ion outlet, several separate housing components are provided, at least one of which is grounded and at least one other is ungrounded. While the ungrounded housing component becomes electrically charged and therefore can divert the ions, the ions can spread out unhindered over the grounded housing components, so that, with a suitable pattern of grounded and ungrounded housing components, the distribution of the discharged ions is appropriately controlled.

Depending on the application, such an ion guiding device can be designed differently, in order to create different distribution patterns. In a preferred embodiment of the invention, a symmetrical pattern is possible of grounded and ungrounded housing components arranged in the vicinity of the ion outlet around the longitudinal plane of the device, resulting in a completely symmetrical ion distribution. Alternatively, however, to create a device specifically for right-handed users or for left-handed users, for example, configurations are possible different from a symmetrical arrangement around the longitudinal plane.

Alternatively, or in addition to the embodiment mentioned above, in order to attach the grounding surface directly to the hair treatment apparatus, the grounding surface on the operational head ("third grounding surface") can also enclose the hair treatment apparatus peripherally, at least in sections, preferably arranged in a ring and/or directly adjacent to the hair treatment apparatus. In particular, a metal strip around the hair treatment apparatus on the operational head can be provided as a grounding surface. In this way, the hair treatment apparatus itself, that is, for example, the bristle field and/or comb tooth field, or the housing body of the operational head itself should be made of non-conductive material. Advantageously, the grounding surface on the operational head is not in the immediate vicinity of at least one ion outlet. Advantageously, the grounding surface can be positioned on the edge next to the hair treatment apparatus in the operational head containing it.

In a further embodiment of the invention, the housing potential is also in electrical contact with the user's body. In a further embodiment of the invention, the handle of the hair care device can have an electrically conductive contact surface to remove positive charges on the user of the hair care device. In this way, the user is protected from a static charge. The discharge of negative ions can even charge the user negatively. On the other hand, positive charges can be transferred to the user through the contact surface on the handle, thereby compensating for the charging effect of the negative ions. This is especially advantageous in a design of the hair care device not connected to the electrical grid, in particular, a battery and/or a rechargeable battery device. With such a non-network device, the generation of negative ions normally produces an equivalent amount of positive charge on the device, because the battery or rechargeable battery device lacks the reference potential. By means of this positive charge on the device, the negative charge of the user can be offset by the electrically active contact surface on the handle mentioned above.

An especially simple design of the ion delivery device is possible, in particular with regard to the ion release configuration by means of the largely interference-free delivery of ions onto the hair, which is achieved by grounding surfaces eliminating or reducing the charge fields on the device. In a further embodiment of the invention, in particular, the ion delivery can take place exclusively on the back side of the device, facing away from the hair treatment apparatus performing the primary function of the hair care device. Surprisingly, an evenly distributed and nevertheless targeted delivery of ions can be directed to the hair in this way. Until now, in order to supply the ions directly in the area to be treated, it has generally been attempted to deliver at least a portion of the ions to the front side of the device in the vicinity of the hair treatment tool, because it was assumed that ions discharged from the backside of the device more or less miss the target, namely the hair to be treated. In particular, in connection with the above described grounding surfaces and the elimination or limitation of disruptive charge fields, discharging ions on the back side of the device can result in an especially even distribution and in a nearly complete discharge of ions onto the hair, because the hair usually has a positive charge which attracts ions to compensate for the discharged ions. If no stronger interference fields are present to hinder the discharge of the ions, this effect is sufficient. By arranging the ion outlet or all of the ion outlets on the back side of the device, the ions are emitted without mechanical interference from the user's hand or from strands of hair near the ion outlet.

In principle, a single ion outlet can be sufficient. Optionally, several ion outlets can be arranged on the back side of the device. In both cases, the arrangement is advantageously symmetrical around the longitudinal plane of the hair care device. Preferably, the at least one ion outlet or the several ion outlets are created so that the main direction of ion emission or the totality of the main directions of ion emission is directed toward or over the plane of the back surface, symmetrical to the longitudinal plane. In this way, the main direction of ion emission from the ion outlet is advantageously—roughly speaking—aligned essentially parallel to the back surface, so that the ions are emitted over this, essentially parallel to the back side of the device. Alternatively, or in addition, ions can be released at a slightly acute angle (upward). In doing so, ions can be released inclined at an angle of preferably 0° to 45°, preferably 0° to 30°, toward the surface of the back side.

To achieve an even distribution of ions on the hair, the at least one ion outlet is arranged on the edge of the back surface of the device lying opposite the hair treatment apparatus so that the ion cloud forms over the back side of the operational head.

In arranging only a single ion outlet, it is advantageous to place it in the longitudinal plane itself. In arranging two ion outlets on the back side of the device, these can be arranged so that they stick out at the same height on the longitudinal place, preferably slightly angled toward the center plane. Alternatively, in positioning two ion outlets on the back side of the device, an opposing configuration can be employed so that the two ion outlets are positioned on opposite edges of the back surface of the operational head and are aligned one on top of the other so as to allow the ions to discharge on top of one another, so to speak.

The hair treatment apparatus can be securely mounted to the operational head and can also be permanently integrated into the operational head. Alternatively, the hair treatment apparatus can advantageously be interchangeably attached to the operational head so that various hair treatment apparatuses can be attached to and usable with an operational head. In addition to a bristle field or comb tooth field, other hair treatment apparatuses can be considered, for example: an apparatus for heat treatment, a heatable hair straightener, a hot air device, perhaps in the form of a hair dryer or a hot air brush. Generally, such various hair treatment apparatuses require different kinds of handling and grasping of the device, so that it is advantageous to offer electrically conductive surfaces of the kind disclosed. In addition, the ion stream should be delivered in such a way that both its strength and its geometrical distribution are very compatible with a variety of operational heads.

Figure 2:
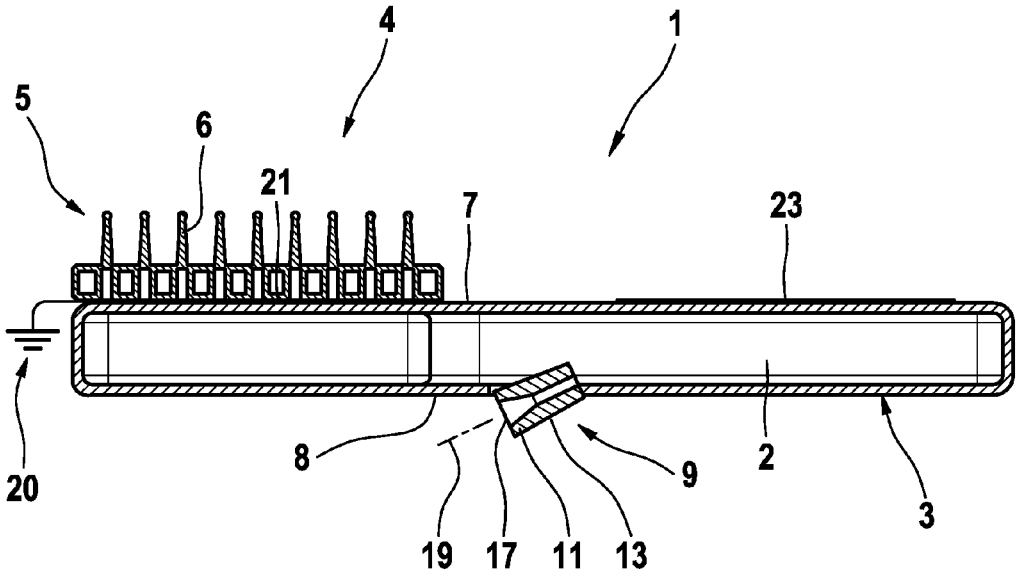
Figure 3:
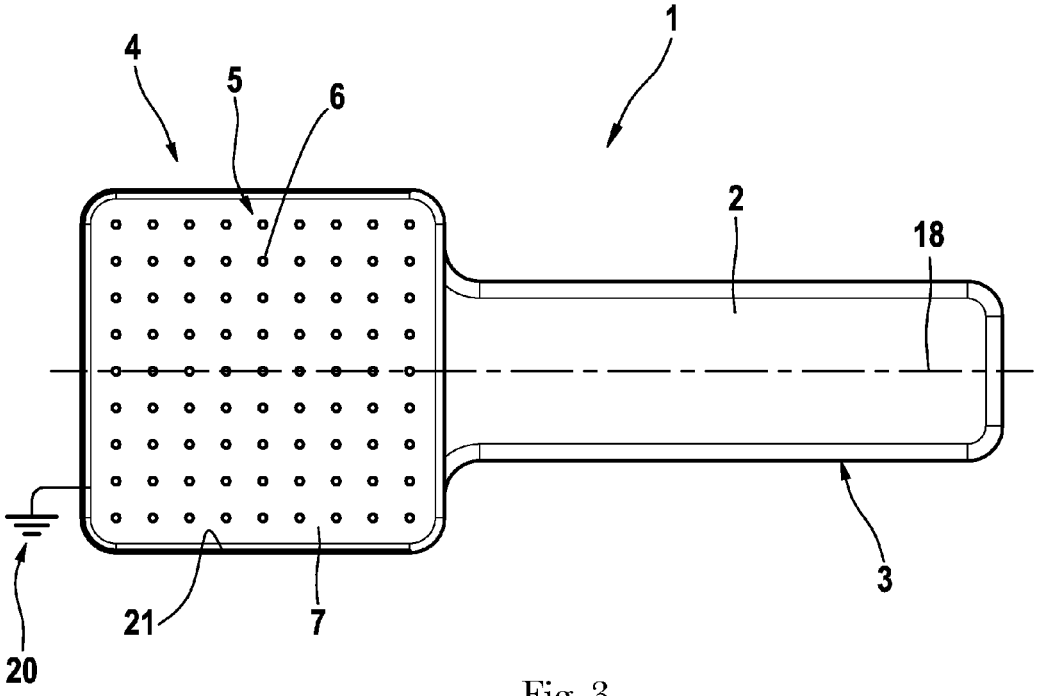
Figure 4:
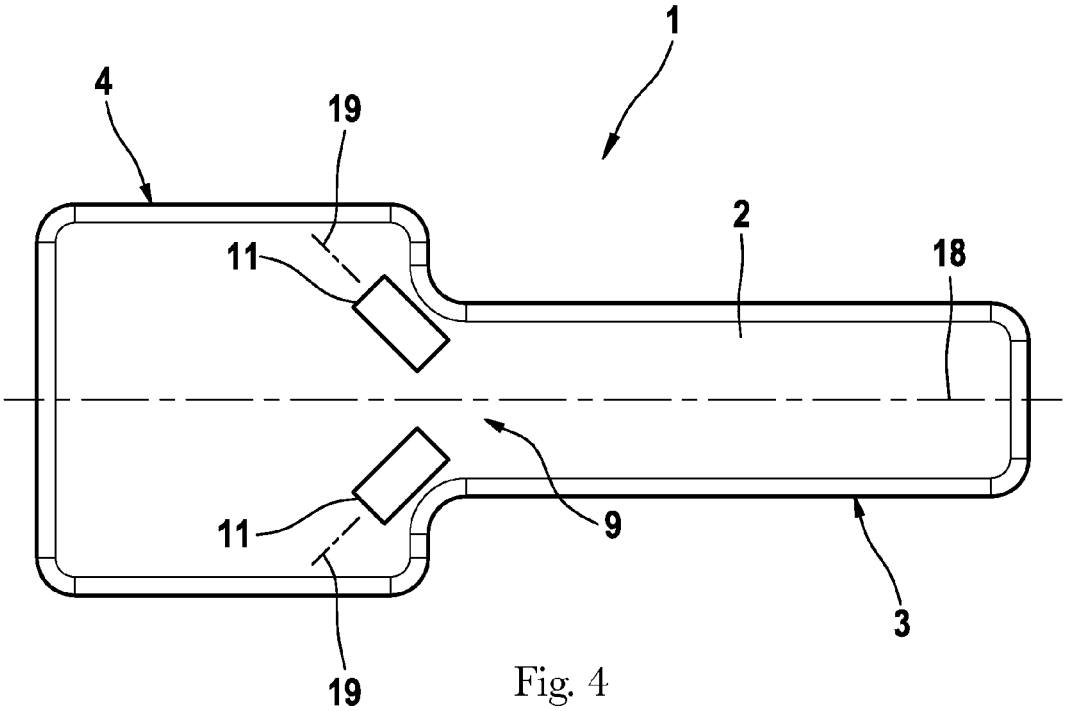
Figure 5:
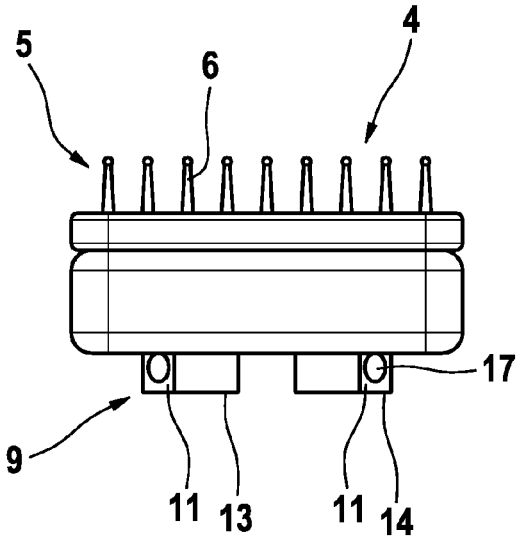
Figure 6:
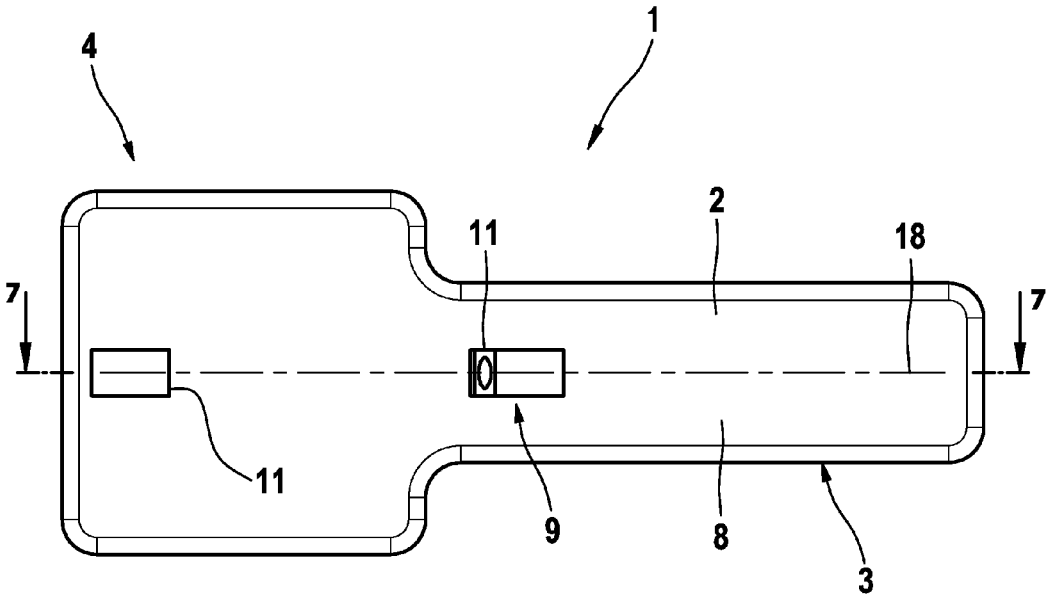
Figure 7:
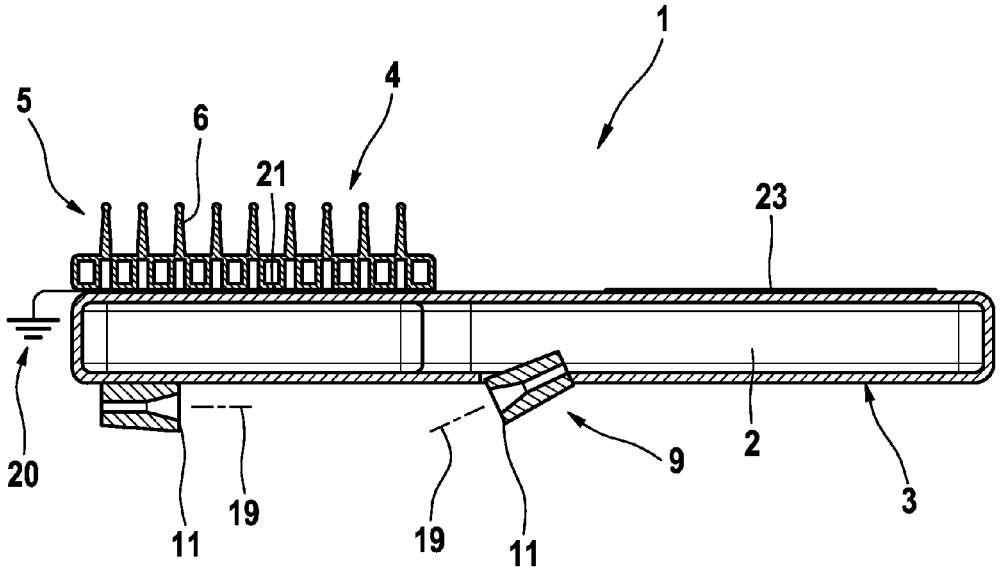
Figure 8:
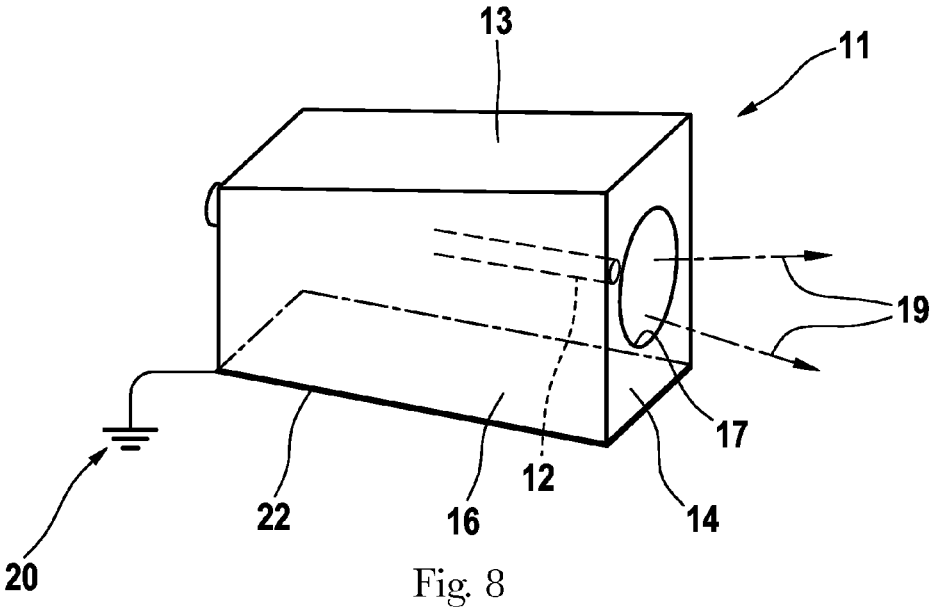
Figure 9:
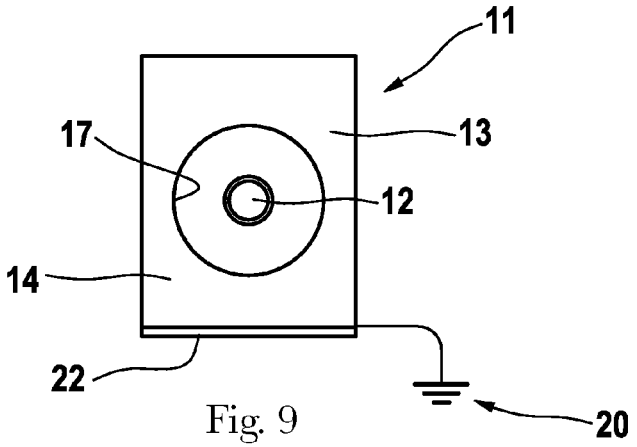
Figure 10:
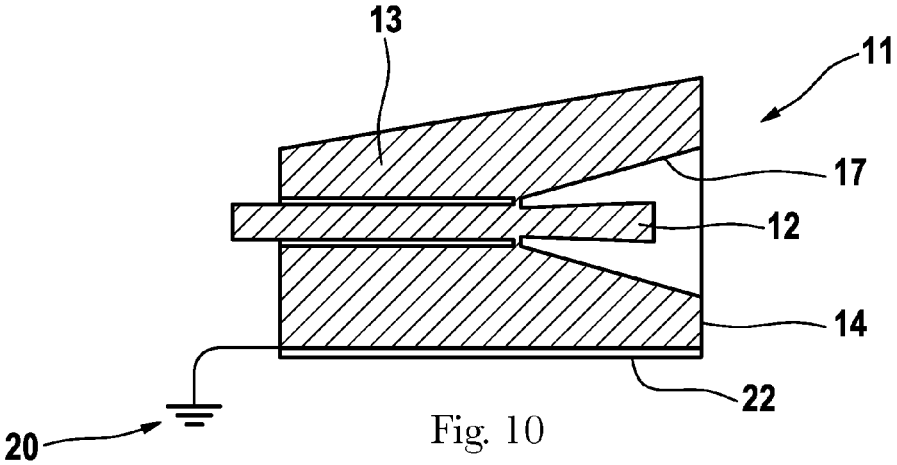
Figure 11:
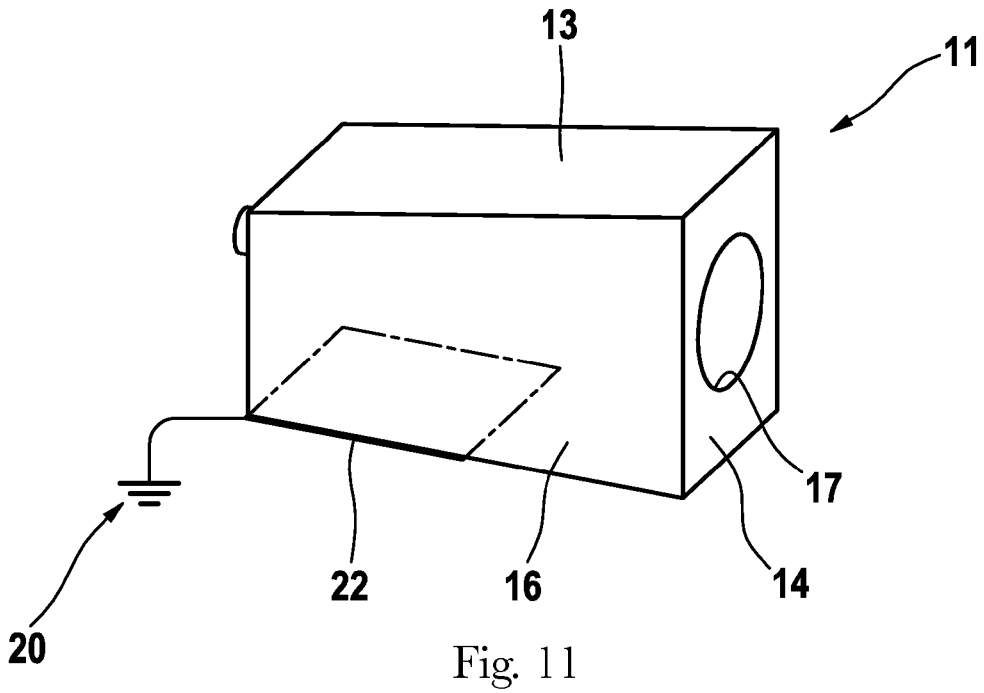
Figure 12:
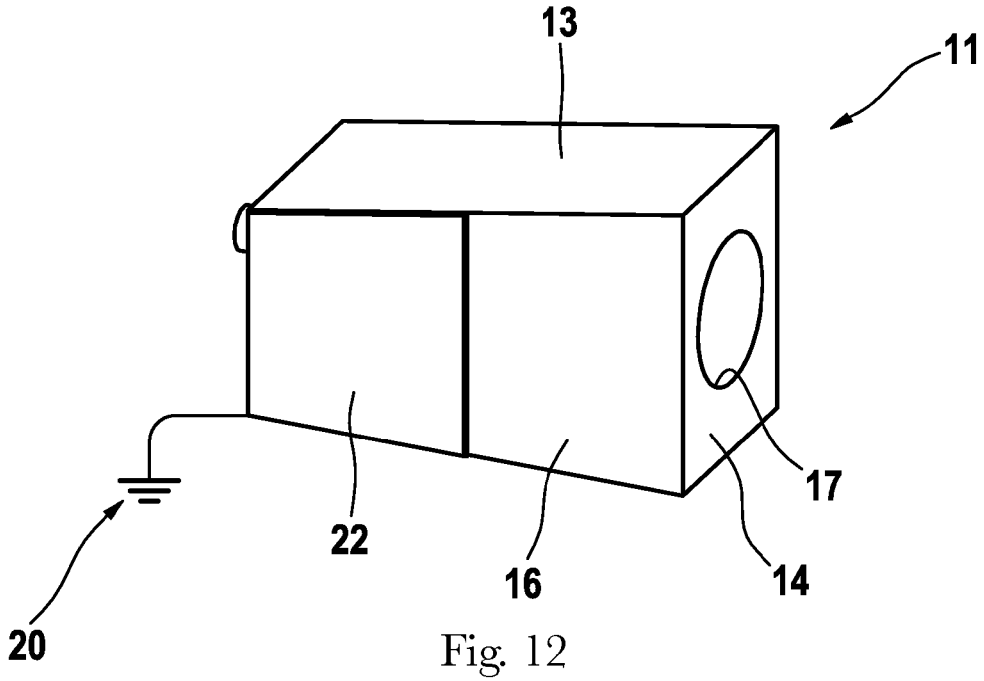
Figure 13:
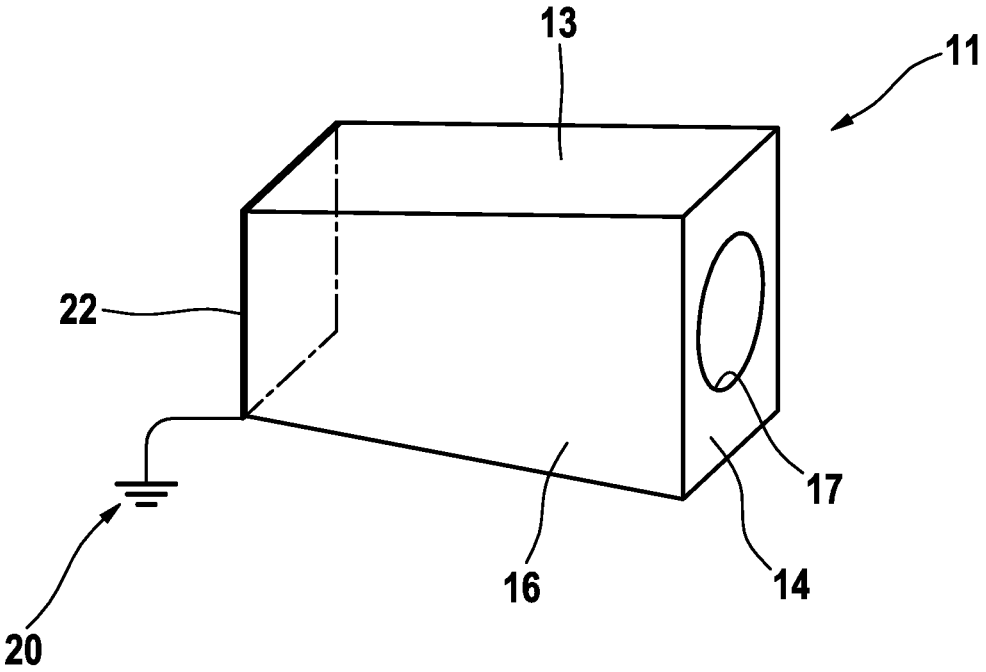
Figure 14:
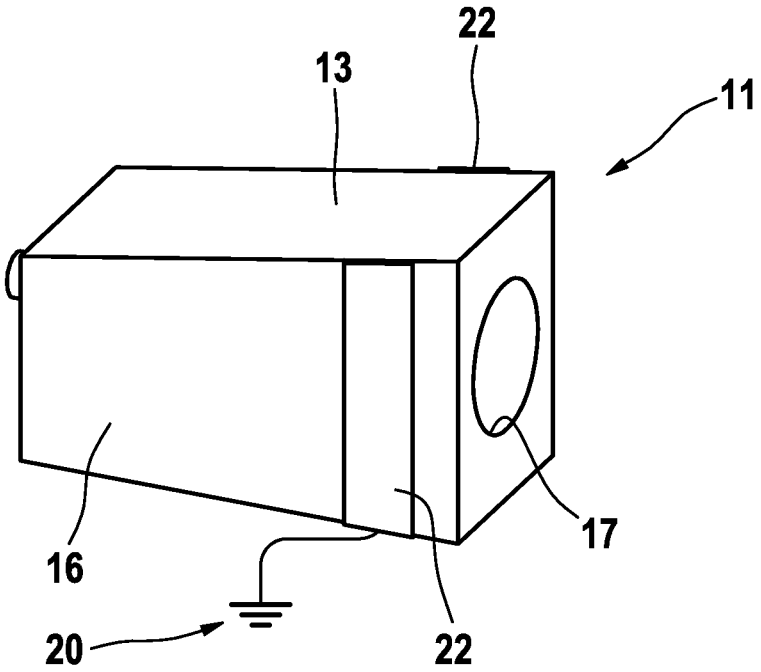
Figure 15:
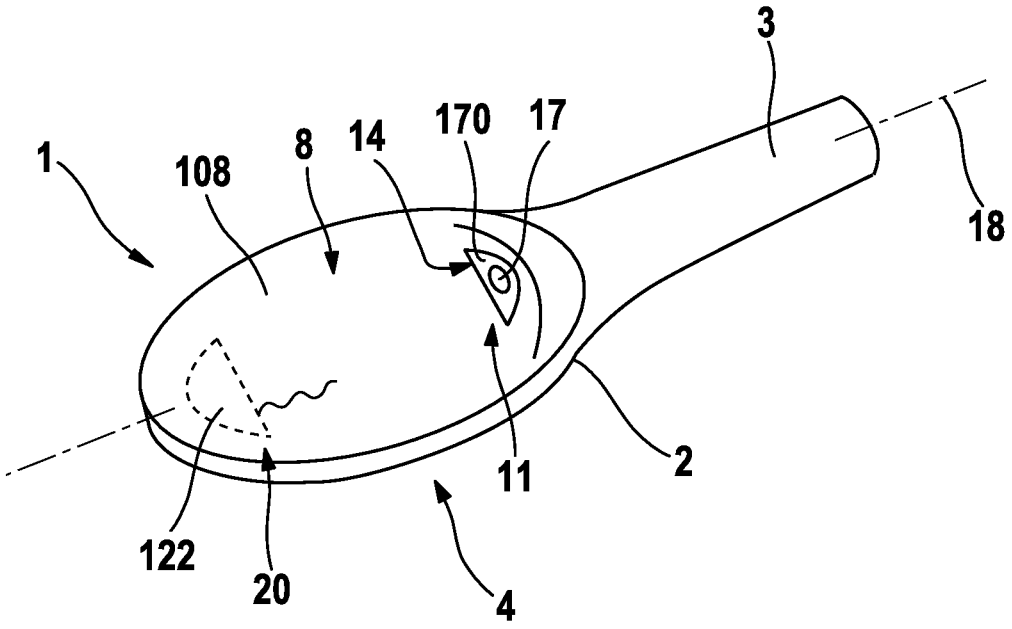
Figure 16:
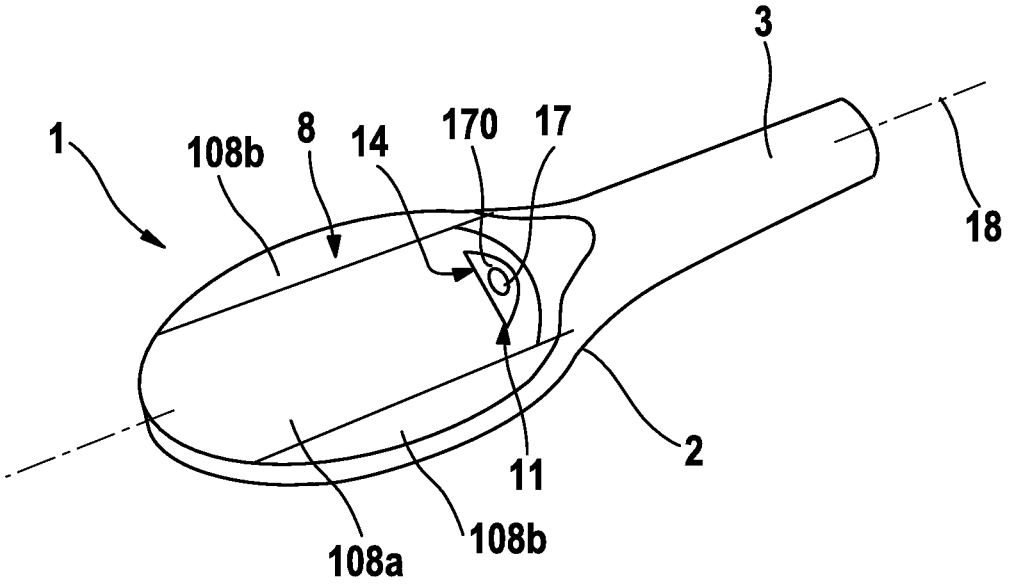

These and other features of the invention are based on the claims, as well as on the following description and/or on the accompanying drawings, wherein the features in various combinations and sub-combinations with one another, as well as separately, can constitute the subject matter of the invention, irrespective of their summary in the claims. The invention will be explained in terms of preferred embodiments and related drawings. In the drawings:

FIG. 1 shows a top view of the back of a hair care device in the form of a hairbrush according to an advantageous embodiment of the invention, which shows the ion outlet in the longitudinal plane at the edge of the back of the operational head, FIG. 2 shows a longitudinal section of the hairbrush in FIG. 1 along Line A-A referenced there, wherein a grounding surface is positioned on the operational head under the comb tooth field provided there, FIG. 3 shows a top view of the front side of a hairbrush according to a further advantageous embodiment of the invention, in which the grounding surface is provided on the operational head as a surrounding metal strip on the edge of a comb tooth field, FIG. 4 shows a top view of the back of a hairbrush according to a further advantageous embodiment of the invention, showing the arrangement of two ion outlets on the edge of the back of the operational head, symmetrical to the longitudinal axis, FIG. 5 shows a frontal view of the hairbrush in FIG. 4 showing the principal direction of discharge of the ion outlets, angled away from one another and essentially parallel to the back surface of the brush, FIG. 6 shows a top view of the back of a hairbrush according to a further advantageous embodiment of the invention, in which two ion outlets are arranged opposite one another in the longitudinal axis of the hairbrush, FIG. 7 shows a longitudinal section of the hair brush in FIG. 6 along Line AA referenced therein, showing the various inclinations of the ion outlets on the back of the hairbrush, FIG. 8 shows a schematic perspective view of the ion outlet and its outlet housing according to a further advantageous embodiment of the invention, in which a bottom surface of the outlet housings is designed as a grounding surface, FIG. 9 shows a frontal top view of the orifice of the ion outlet in FIG. 8, FIG. 10 shows a schematic longitudinal section through the ion outlet of the two previous figures, FIG. 11 shows a perspective schematic illustration of an ion outlet according to an alternative advantageous embodiment of the invention, in which only a partial area of the bottom side of the outlet housing is designed as a grounding surface, FIG. 12 shows a schematic perspective illustration of an ion outlet according to a further advantageous embodiment of the invention, in which a portion of a side of the outlet housing is designed as a grounding surface, FIG. 13 shows a perspective view schematic of an ion outlet according to a further advantageous embodiment of the invention, in which the back side of the outlet housing opposite the orifice is designed as a grounding surface, FIG. 14 shows a schematic perspective illustration of an ion outlet according to a further advantageous embodiment of the invention, in which two side surfaces of the outlet housing positioned opposite one another are each designed as partial grounding surfaces, FIG. 15 shows a schematic perspective view of a hair care device in the form of a hairbrush according to a further advantageous embodiment of the invention, with an ion outlet on the back of the hairbrush, wherein the housing component of the device is grounded in the vicinity of the ion outlet, and FIG. 16 shows a schematic perspective view of a hair care device similar to FIG. 15, wherein several separate components are provided in the vicinity of ion outlets on the back of the device, only one of which is grounded and the others are ungrounded.

The hair care device 1 shown in FIGS. 1 and 2 comprises a device grounding body 2 which has a handle 3 and has electronic mechanisms described below in its interior or on its outer shell. Said handle 3 supports an operational head 4 which carries a brush field 6 as a hair treatment apparatus 5 on the front side of the device 7. It is understood, however, that other hair processing tools, such as for example, heating elements or hair styling elements or possibly even a blower outlet, may be provided if the hair care device is designed as a hair styling device and/or as a hair dryer. The named hair treatment tools can also optionally be combined with one another.

Said hair treatment apparatus 5 can be permanently integrated into the operational head 4. Alternatively, the hair treatment apparatus 5 can advantageously be mounted so as to be interchangeable on the operational head 4 so that an operational head 4 can be equipped and usable with various hair treatment apparatuses 5.

Advantageously, the hair care device 1 can have a modular design with several interchangeable components, wherein, in particular, the entire operational head 4 and/or the hair treatment apparatus 5 may be formed separately from the grounding body 2 of the device in the manner described above. In this connection, positive fitting fasteners can advantageously be provided between the various components, in the form of snap-in pins and sockets, enabling the components to be removed and reinstalled without tools.

As shown in FIGS. 1 and 2, an ion releasing device 9 is additionally provided on the grounding body of the device 2 on the back side of the device 8 facing away from the hair treatment apparatus 5, comprising an ion emitter, which can have a high voltage element 12 for release of ions arranged in the interior of the grounding body of the device 2, and/or in the ion outlet 11. Said high voltage element 12 can be arranged in a case or a shell-like outlet housing 13, the walls of which have an outlet opening 17 on the orifice side 14, through which the generated ions can exit.

In the illustrated embodiment, the ion outlet 11 is designed as a nozzle or a diffuser and produces a directed ion discharge; cf. FIG. 2. Advantageously, the ion outlet 11 is arranged on the back side of the device 8 opposite the bristle field 6 and/or faces away from it, and forms the back of the hairbrush, so to speak. Advantageously, the ion outlet 11 is arranged in the longitudinal plane 18, which forms the plane of projection of FIG. 2, wherein advantageously the ion outlet 11 with its main outlet direction 19 is slightly inclined at an acute angle to the back surface of the device and is directed away from it; cf. FIG. 2, wherein the angle of inclination can be advantageously between 0° and 45°, and may be advantageously approximately between 20° and 30° in the illustrated embodiment. In particular, as shown in FIGS. 1 and 2, the ion outlet 11 is arranged on the edge of the back surface of the operational head opposite the bristle field 6, so that the ions discharged from the ion outlet 11 form a cloud of ions over the back of the operational head 4. In particular, the ion outlet 11, as shown in FIG. 1, for instance, can be positioned, roughly speaking, approximately in the transitional zone between the handle 3 and the operational head 4.

Inside the grounding body 2 of the device, a power supply unit, not specifically illustrated, is housed, which preferably can be designed in the form of a battery or rechargeable battery device.

Advantageously, the hair care device 1 is designed to be energy self-sufficient, i.e., it does not have a permanent power adaptor that would deliver electricity from the electric socket. Of course, a power cord can be plugged in to charge the rechargeable batteries inside the grounding body 2 of the device. The ion discharging device 9 is powered by said power supply unit, in order to generate ions.

As shown in FIG. 2, the hair care device 1 is advantageously provided with a grounding device 20 to prevent unwanted charging of the device, to prevent interference with ion discharge and to improve the operational safety of the device. In the illustrated embodiment according to FIG. 2, the grounding device 20 in the operational head 4 can have a grounding surface 21 ("third grounding surface") to prevent strong charge fields from developing in the vicinity of the operational head 4, especially in the vicinity of the hair treatment apparatus 5. In the embodiment according to FIG. 2, the grounding surface 21 is attached directly to the hair treatment apparatus 5, wherein it is designed as a carrier and is positioned under the hair treatment apparatus 5, and attached to it; cf. FIG. 2. The grounding surface 21 is advantageously made of a metal surface and/or a metal coating applied to the body of the operational head, typically made of plastic. The grounding surface 21 can be connected to the ground potential of the circuit, for example through custom components arranged inside the device.

Alternatively, or in addition, the grounding surface 21 on the operational head side can also have a body with a metal surface on the edge of the bristle field 6, preferably in the form of a metal strip surrounding the bristle field 6 in a ring shape, or, as shown in FIG. 3, surrounding it on three sides in a U-shape. The bristle field 6 and the rest of the body of the operational head 4 can be designed to be non-conductive, in particular, made of plastic. In the case of a grounding surface 21 at the edge of the bristle field 6 according to FIG. 3, the grounding surface 21 surrounds a large enough portion of the bristle field 6 to sufficiently compensate for the charges arising there. Advantageously, the metal strip will extend over at least 50% of the area of the hair treatment apparatus 5.

As FIGS. 4 and 5 show, the back side 8 of hair care device 1 may also have several ion outlets 11, wherein, in the illustrated embodiment according to FIGS. 4 and 5, two ion outlets are provided, which, when seen from the longitudinal axis of the device, are at the same height and are positioned symmetrically to each other with respect to the longitudinal plane 18.

Advantageously, the ion outlets 11 are positioned on the edge of the back of the operational head, wherein they are inclined to one another at an angle of magnitude of 60° to 120°, preferably approximately 90°, to produce a uniformly distributed ion cloud. In the illustrated embodiment, the ion outlets 11 with the main outlet direction 18 are parallel to the surface of the back side 8, so that the ions are discharged essentially parallel to the back of the operational head. In the embodiment shown, the ions can be discharged from the ion outlets 11 in divergent directions in order to distribute the ion cloud evenly over the operational head 4 or over its back side.

Alternatively to the embodiment according to FIGS. 4 and 5, several ion outlets 11 can be arranged in the longitudinal plane 18; cf. FIGS. 6 and 7. Advantageously, the two ion outlets 11 are positioned opposite one another, wherein they are arranged along the edges on opposite sides of the back of the operational head, in order to allow the ion cloud to disperse over the back side of the operational head; cf. FIGS. 6 and 7.

Advantageously, the two ion outlets 11 may thereby be variously inclined to the surface of the back of the device. While one ion outlet with its main outlet direction 18 is essentially parallel to the surface of the back of the device 8, the other ion outlet 11 is inclined slightly toward the said surface of the back of the device 8, preferably at an angle of 0° to 40°, in particular of 10° to 30°. As FIGS. 6 and 7 show, it can be especially advantageous if the ion outlet 11 arranged in the transitional zone between the handle 3 and the operational head 4 is slightly inclined, whereas the ion outlet 11 positioned at the end of the back of the operational head remote from the handle 3 can be arranged parallel to the back side of the device 8.

As shown by FIGS. 8 through 10, the grounding device 20 mentioned above also advantageously comprises a grounding surface 22 attached to an ion outlet 11 ("first grounding surface"). In particular, this grounding surface 22 is provided on an outer surface of the outlet housing 13 enclosing the ion emitter or its high-voltage element 12. As FIG. 8 shows best, the roughly box-shaped outlet housing 13 encloses orifice 14 which forms the front side, in which an outlet opening 17 is provided for discharging the emitted ions. The high-voltage element 12 is arranged in the center of the outlet housing 13 and ends shortly before the said outlet opening 17 inside the outlet housing 13; cf. FIG. 10. Typically, the high voltage element 12 comprises wire or consists of such, which is generally guided in an isolated sheath, while the outlet housing is generally made of a different, third material, for example made of plastic (the schematic FIG. 10 does not make material differences apparent).

In the embodiment according to FIGS. 8 to 10, based on the high-voltage element 12 circumferential, a side surface 16 is provided with the grounding surface 22. According to FIGS. 8 through 10, this can be a bottom side of the outlet housing 13 facing the grounding body 2. Alternatively or additionally, this can also be a side wall surface 16 of the outlet housing 13, as FIG. 12 shows.

According to FIGS. 8 through 10, the entire bottom side of the outlet housing 13 is designed as a grounding surface 22, in particular in the form of a metal surface, wherein the remainder of the housing is non-conductive and in particular can be made of plastic. As FIG. 11 shows, the corresponding surfaces—in the case of FIG. 11, the bottom side of the side surface—of the outlet housing 13 also can be provided with the grounding surfaces 22 only in sections, namely, the grounding surfaces 22 need not necessarily cover the entire side surface; cf. FIG. 11.

Also in the embodiment according to FIG. 12, only about half of the side surface 16 is designed as a grounding surface 22.

As FIG. 13 shows, the back of the outlet housing 13 opposite the orifice 14 can also be designed as a grounding surface 22.

Another embodiment is shown in FIG. 14. In this case, opposing side surfaces 16 of the outlet housing 13 are each provided with a grounding surface 22, wherein, in the illustrated embodiment, these are designed only in the form of a strip partially covering the side surfaces 16.

FIG. 15 shows a hair care device 1 according to another embodiment of the invention. Unless otherwise stated, this hair care device may correspond to the preceding embodiments, wherein corresponding reference numerals are used for corresponding components in FIG. 15. The hair care device according to FIG. 15 essentially differs from the previous in that the entire back of the operational head is grounded. The housing component 108 which forms the back of the operational head 4 and encloses the ion outlet 11, itself consists of a non-conductive material, in particular plastic, so that the housing component 108, as such, can be electrostatically charged.

Said housing component 108 is grounded, however, by means of contact with the ground potential of the high voltage circuit, whereby an electrostatic charge, while not impossible, is sufficiently limited so that the electrical counter fields generated by the charge are so small that the distribution of the ions from the ion outlet is not impeded. In this way, electrical grounding can take place on the grounding surface 122 ("second ground plane"). In this way, the grounding surface 122 can also be designed as an electrically contacted screw in a screw boss in the housing component 108. Alternatively or additionally, pressure from a metal electrode can be applied to the housing component 108, preferably on the inside. In both cases, therefore, a grounding surface attached to the ground potential positioned on the housing component 108 prevents or suppresses electrostatic charging.

As FIG. 15 shows, the grounded housing component 108 extends to the vicinity of the ion outlet 11, essentially over the entire surface of the back surface of the body of the device or of the section of it over which the ion cloud emerging from ion outlet 11 disperses. The grounded housing component 108 extends from the back side of the ion outlet 11 facing away from the orifice 14 of the ion outlet 11, initially over a large surface up to the ion outlet 11, i.e. downstream from said ion outlet 11 in the direction of the discharged ions from said ion outlet 11; cf. FIG. 15. The ion outlet 11 forms an island, so to speak, in the surface of the grounded housing component 108, wherein the larger portion of the housing component 108, in the embodiment illustrated more than two thirds of the housing component 108, is located on the discharge side of the ion outlet 11; cf. FIG. 15.

In this way, the said ion outlet 11 is integrated into the said housing component 108, in particular, the latter arches up dome-shaped, to make room for the outlet opening 17 of ion outlet 11, which, in the illustrated embodiment, is preferably formed from a plastic sleeve 170, which encompasses the ion emitter on the outlet side; cf. FIG. 15.

Instead of grounding the housing component in the exit area of the ion emitter across the entire surface shown in FIG. 15, several separate housing components 108*a* and 108*b* can be provided in the vicinity of the ion outlet, as shown in FIG. 16, at least one of which is grounded, while at least one of which is not grounded. The non-grounded parts may be electrostatically charged, whereby the ions are deflected. In contrast to this, the ions can spread out unaffected over the grounded parts, so that an overall control of the ion cloud is achieved. In this way, the pattern of grounded and ungrounded housing parts in the vicinity of the ion outlet 11 forms an ion control mechanism.

As FIG. 16 shows, this ion control mechanism or the pattern of grounded and ungrounded housing components 108*a* and 108*b* can advantageously be arranged or designed symmetrically to the longitudinal axis 18 of the hair care device 1. Specifically, FIG. 16 illustrates a central housing component 108*a* extending from the ion outlet 11 in a trapezoidal shape, grounded in the aforementioned manner This central strip housing component 108*a* is flanked on the left and on the right by two side housing components 108*b*, which remain ungrounded, and thus can be electrostatically charged. In this embodiment, the ion control mechanism forms an exit corridor or channel, so to speak, which allows for a targeted ion discharge and suppresses excessive lateral spreading. Depending on the application, however, other patterns of grounded or ungrounded housing components can be provided in order to achieve suitable control of distributing the ion cloud according to the application.

What is claimed is:

1. A hair care device comprising:

a handle;

an operational head attached to the handle, where the operational head comprises a hair treatment apparatus comprising a bristle field and/or a comb tooth field;

a back side of the device facing away from the hair treatment apparatus;

an ion-producing apparatus having a high-voltage circuit for producing ions on the hair, having at least one switching unit, an ion source placed within a housing component where the housing component has an ion outlet, and grounding surface for the removal/limiting of electrical charges, is arranged on an external surface of the housing component in a vicinity of the ion outlet and the grounding surface is in electrical connection with the grounding potential of the high-voltage circuit, wherein the ion source has a potential level of −10 to −3 KV relative to the potential level of the grounding surface, the housing component has a potential level of −2.5 to −1 KV relative to the potential level of the grounding surface, and the back side of the device has a potential level of −500 to −100V relative to the potential level of the grounding surface.

2. The hair care device of claim 1, wherein the switching unit has the same potential level as the grounding surface.

3. The hair care device of claim 1, wherein the said back side of the device in the vicinity of the ion outlet is provided with at least one additional grounding surface.

4. The hair care device of claim 3, wherein the additional grounding surface is positioned downstream of the ion outlet.

5. The hair care device of claim 1, wherein the grounding surface comprises a metal surface.

6. The hair care device of claim 3, wherein an additional grounding surface is arranged on the operational head.

7. The hair care device of claim 6, wherein the grounding surface on the operational head encloses the hair treatment apparatus, at least in sections and/or is arranged directly adjacent to the hair treatment apparatus.

8. The hair care device claims of claim 1, wherein the housing component is in the form of a sheath.

9. The hair care device of claim 1, wherein the ion outlet is designed to be free of counter electrodes.

10. The hair care device of claim 1, wherein the ion outlet is arranged on the back side of the device facing away from the hair treatment apparatus.

11. The hair care device of claim 1, further comprising at least one additional ion outlet, wherein the ion outlets are arranged around the edges of the back side of the operational head in such a way that an ion cloud is generated over the back side of the operational head.

12. The hair care device of claim 11, wherein an energy storage device is provided to power the ion discharging device.

13. The hair care device of claim 12, wherein at least one of the operational head and the hair treatment apparatus is removably attached to the handle.

14. The hair care device of claim 1 comprising only one ion outlet.

* * * * *